US009565948B2

(12) United States Patent
Yang

(10) Patent No.: US 9,565,948 B2
(45) Date of Patent: Feb. 14, 2017

(54) ENHANCED FOLDING BED BRACKET

(71) Applicant: ZHEJIANG HENGFENG TOPLEISURE CO., LTD, Deqing County, Zhejiang (CN)

(72) Inventor: Baoqing Yang, Hangzhou (CN)

(73) Assignee: ZHEJIANG HENGFENG TOPLEISURE CO., LTD, Wukang Town, Deqing County, Zhejiang (CN)

( * ) Notice: Subject to any disclaimer, the term of this patent is extended or adjusted under 35 U.S.C. 154(b) by 120 days.

(21) Appl. No.: 14/550,646

(22) Filed: Nov. 21, 2014

(65) Prior Publication Data

US 2016/0058198 A1 Mar. 3, 2016

(30) Foreign Application Priority Data

Aug. 28, 2014 (CN) ..... 2014 2 04922776 U

(51) Int. Cl.
*A47C 17/72* (2006.01)

(52) U.S. Cl.
CPC ..... *A47C 17/72* (2013.01)

(58) Field of Classification Search
CPC ..... A47C 17/64; A47C 17/68; A47C 17/72; A47C 17/74; A47C 17/82; A47C 19/12
USPC ..... 5/110–117
See application file for complete search history.

(56) References Cited

U.S. PATENT DOCUMENTS

| | | | | | |
|---|---|---|---|---|---|
| 1,276,539 | A * | 8/1918 | Juten | A47C 17/68 | 5/112 |
| 1,287,286 | A * | 12/1918 | Gannon | A47C 19/14 | 5/115 |
| 1,335,456 | A * | 3/1920 | Nelson | A47C 17/64 | 135/143 |
| 3,564,687 | A * | 2/1971 | Kramer | A47C 17/72 | 29/11 |
| 6,618,879 | B1 * | 9/2003 | Wu | A47C 17/70 | 5/110 |
| 2012/0047649 | A1 * | 3/2012 | Grace | A47C 17/64 | 5/110 |
| 2015/0282629 | A1 * | 10/2015 | Lamke | A47C 19/126 | 5/111 |

FOREIGN PATENT DOCUMENTS

| | | | | |
|---|---|---|---|---|
| DE | 1529487 A1 * | 4/1970 | ..... | A47C 17/64 |
| FR | 1255418 A * | 3/1961 | ..... | A47C 17/72 |

* cited by examiner

*Primary Examiner* — Robert G Santos
*Assistant Examiner* — Myles Throop
(74) *Attorney, Agent, or Firm* — Global IP Services; Tianhua Gu

(57) ABSTRACT

A enhanced folding bed bracket, lean leg bars are installed on both sides of the X shaped folding bracket for dispersing the force received by the bracket, the lean leg bars are linked with the leg bars of the bracket through connecting member, thereby the lean leg bar can be folded or unfolded along with the fold or unfold of the fold folding frame. The strength of the bracket is increased, in the mean time the folding or unfolding is not affected. The improved enhanced folding bed bracket, its bracket receives much less force, is not easy to be deformed and folding and unfolding are easy.

10 Claims, 4 Drawing Sheets

ENHANCED FOLDING BED BRACKET

CROSS REFERENCE TO RELATED PATENT APPLICATION

The present application claims the priority of the CN application No. 2014204922776 filed on Aug. 8, 2014, which application is incorporated herein by reference.

FIELD OF THE INVENTION

The present invention relates to a folding bed, an enhanced folding bed bracket.

BACKGROUND OF THE INVENTION

Folding bed, the name suggests that you can fold the bed. Often, the folding bed is made by a wooden or metal frame tied by canvas, it always is used for the field work or the march, it can be folded to put in a small bag for easy carry. More and more people participate in outdoor recreation, camping and other activities, so that folding bed market is also growing, accompanied by, consumers require increasingly high quality for the folding bed.

Chinese patent application No. "201,320,678,955.3" discloses a folding bed, including at least three X-shaped folding stands, a bed cloth, a head bar, an end bar, two side bars, L-shaped connecting members and the T-shaped connecting members. Said side bar is composed by two connected fulcrum bars, and both ends of the side bar are connected with the head bar and end bar respectively to form a square frame for supporting the bed cloth. Wherein two X-shaped folding frame connect with end of the side bars by the L-shaped members, the third X-shaped folding frame is provided at the junction of two fulcrum bars through the T-shaped connecting members. The volume of the folding bed is made smaller by five times folding, more convenient to carry. However, such a problem that the structure is only applicable to the bed width of the smaller design. The leg bars of the X-shaped folding frame and the ground constituting the ground angle is small, usually about 30°, resulting in the leg bars receive a large force, when applying the design to the bed with greater width, the force applied to the leg bars will increase, such structural design of folding beds tend to be difficult to pass the load tests, the leg bar is easily deformed, which affects the use performance and service life.

SUMMARY OF THE INVENTION

The present invention aims to overcome the deficiencies in the prior art, and to provide structural design which is reasonable, higher strength reinforced folding bed bracket.

The present invention is used to solve the above problem by the idea that installing on each side of the X-shaped folding frame the lean leg bar for dispersing the force received and through the linkage between the bar members and the leg bars achieve the result that the lean leg bar can be folded or unfolded along with the fold or unfold of the fold folding frame. Therefore, the strength of the bed bracket is improved, while the folding and unfolding of the folding bed is not affected. By this idea two kinds of technical solutions are provided for improving the bracket strength of a folding bed.

First Technical Solution

A enhanced folding bed bracket, including a head bar, a end bar, a first side bar, a second side bar, a rectangle frame composed by the head bar, end bar, first side bar and second side bar, and a bed cloth supported by the rectangle frame.

The first side bar and second side bar are composed respectively by two fulcrum bars which are connected by a T connecting member. Support frames are provided in front, rear and middle of the rectangle frame respectively.

The support frame located in middle of the rectangle frame comprises an intermediate long leg bar, first intermediate short leg bar, second intermediate short leg bar and first Z connecting member, ends of the first and second intermediate short leg bars are installed in two ends of the first Z connecting member respectively, a middle part of the intermediate long leg bar is hinge jointed with a middle part of the first Z connecting member, other end of the first intermediate short leg bar and one end of the intermediate long leg bar are hinge jointed with the T connecting member located in a middle part of the first side bar and the T connecting member located in the middle part of the second side bar respectively.

The support frame located in middle of the rectangle frame further comprises a first intermediate lean leg bar, first connecting member, second intermediate lean leg bar and second connecting member, ends of the first and second intermediate lean leg bars are fixed with first and second L connecting members respectively.

The first L connecting member, second L connecting member are hinge jointed with the first intermediate short leg bar and intermediate long leg bar respectively, two ends of the first connecting member are hinge jointed with the first intermediate lean leg bar and intermediate long leg bar respectively, two ends of the second connecting member are hinge jointed with the second intermediate lean leg bar and second intermediate short leg bar respectively, other end of the intermediate long leg bar and other end of the second intermediate short leg bar are fixed a first leg cap and a second leg cap respectively, the first leg cap has a first socket slot for splicing connect with an end of first intermediate lean leg bar, the second leg cap has a second socket slot for splicing connect with an end of second intermediate lean leg bar.

As preference, support frames located in front and rear of the rectangle frame comprise the first front leg bar, second front leg bar, third front leg bar, second Z connecting member, first front lean leg bar, second front lean leg bar, third L connecting member, fourth L connecting member, fifth L connecting member, sixth L connecting member, third connecting member and fourth connecting member, one end of the first front leg bar and one end of the second front leg bar are installed in two ends of the second Z connecting member respectively, the third front leg bar is hinge jointed with middle part of the second Z connecting member, one end of the first front leg bar and one end of the third front leg bar are fixed with the third L connecting member and fourth L connecting member respectively, the third L connecting member and fourth L connecting member are hinge jointed with end of the first side bar and end of second side bar respectively.

End of the first front lean leg bar and end of the second front lean leg bar are fixed with the fifth L connecting member and sixth L connecting member respectively, the fifth L connecting member and sixth L connecting member are hinge jointed with the first front leg bar and third front leg bar respectively, two ends of the third connecting member are hinge jointed with middle part of first front lean leg bar and another end of third front leg bar respectively, two ends of the fourth connecting member are hinge jointed with middle part of the second front lean leg bar and another end of the second front leg bar respectively.

As preference, the first front lean leg bar and second front lean leg bar are fixed with third leg cap and fourth leg cap respectively.

As preference, the first Z connecting member and second Z connecting member are composed respectively by two Z connecting pieces respectively. The T connecting member is composed by two T connecting pieces. The first, second, third, fourth, fifth, and sixth L connecting members are composed respectively by two T connecting piece respectively.

As preference, two ends of the head bar are inserted in the end of first side bar and the end of second side bar respectively. Two ends of the end bar are inserted in the another end of first side bar and another end of second side bar respectively.

Thereby, a rectangle frame for supporting bed cloth is composed. As preference, after the enhanced folding bed bracket being unfolded the first intermediate lean leg bar is perpendicular to the first intermediate short leg bar, the second intermediate lean bar leg is perpendicular to the intermediate long leg bar. As preference, the first front leg bar is hinge jointed with the first lapping bar used for lapping on the first side bar. The third front leg bar is hinge jointed with second lapping bar used for lapping on the first side bar.

Second Technical Solution

A enhanced folding bed bracket, comprising a head bar, an end bar, a first side bar and a second side bar, the head bar, end bar, first side bar and second side bar compose a rectangle frame to support a bed cloth, the first side bar and second side bar are composed respectively by two fulcrum bars which are connected by a T connecting member, a front, rear and middle of the rectangle frame are provided with the support frames.

Support frames located in front and rear of the rectangle frame comprise the first front leg bar, second front leg bar, third front leg bar, second Z connecting member, first front lean leg bar, second front lean leg bar, third L connecting member, fourth L connecting member, fifth L connecting member, sixth L connecting member, third connecting member and fourth connecting member, one end of the first front leg bar and one end of the second front leg bar are installed in two ends of the second Z connecting member respectively, the third front leg bar is hinge jointed in middle part of the second Z connecting member.

One end of the first front leg bar and one end of the third front leg bar are fixed with the third L connecting member and fourth L connecting member respectively. The third L connecting member and fourth L connecting member are hinge jointed with end of the first side bar and the end of second side bar respectively, end of first front lean leg bar and end of second front lean leg bar are fixed with the fifth L connecting member and sixth L connecting member respectively. The fifth L connecting member and sixth L connecting member are hinge jointed with the first front leg bar and third front leg bar respectively, two ends of the third connecting member are hinge jointed with middle part of the first front lean leg bar and another end of third front leg bar respectively, two ends of fourth connecting member are hinge jointed with middle part of second front lean leg bar and another end of the second front leg bar respectively.

As preference, after the enhanced folding bed bracket being unfolded the first front lean leg bar is perpendicular to the second front leg bar, the second front lean bar leg is perpendicular to the third front leg bar.

As preference, the first front lean leg bar and the second front lean leg bar are fixed with third leg cap and fourth leg cap respectively.

The present invention as compared with the prior art has the following advantages and effects:

1) After the folding bed being unfolded, the first intermediate lean leg bar and second intermediate lean leg bar provide good support to the first intermediate short leg bar and intermediate long leg bar. The first intermediate lean leg bar and second intermediate lean leg have a bigger included angle with ground, which can be 60°. The received forces by the first intermediate short leg bar, second intermediate short leg bar, intermediate long leg bar, first Z connecting member are decreased much, thereby they are not easy to be distorted. During using the folding bed can be folded or unfolded easy and fast.

After unfolding, another end of the intermediate long leg bar links with another end of the first intermediate lean leg bar by the first leg cap, another end of the second intermediate shot leg bar links another end of the second intermediate lean leg bar by the second leg cap, thereby, the first intermediate lean leg bar and second intermediate lean leg bar sustain the intermediate long leg bar and the second intermediate short leg bar respectively, that avoids the intermediate long leg bar and the second intermediate lean leg bar being closed up inward after unfolding of the bed to keep neat level of the bed.

2) After unfolding of the bed, the first front lean leg bar, second front lean leg bar provide good support to the first front leg bar and third front leg bar respectively. The first front lean leg bar and second front lean leg bar have a larger closed angle with ground, which becomes 60°, the force received by the first front leg bar, second front leg bar, third front leg bar and second Z connecting member respectively is decreased much, thereby distorting is not easy. As the bottom ends of the second and third front leg bars are in a distance from ground the lengths of the second and third front leg bars are shorten, which reduces the cost for material. In the using the folding or unfolding of the bed is fast and easy.

DETAIL DESCRIPTION OF THE INVENTION

In conjunction with the accompanying drawings and the detailed description of embodiments of the present invention, the following examples are for the interpretation of the invention, the invention is not limited to the following examples.

Figure 1:
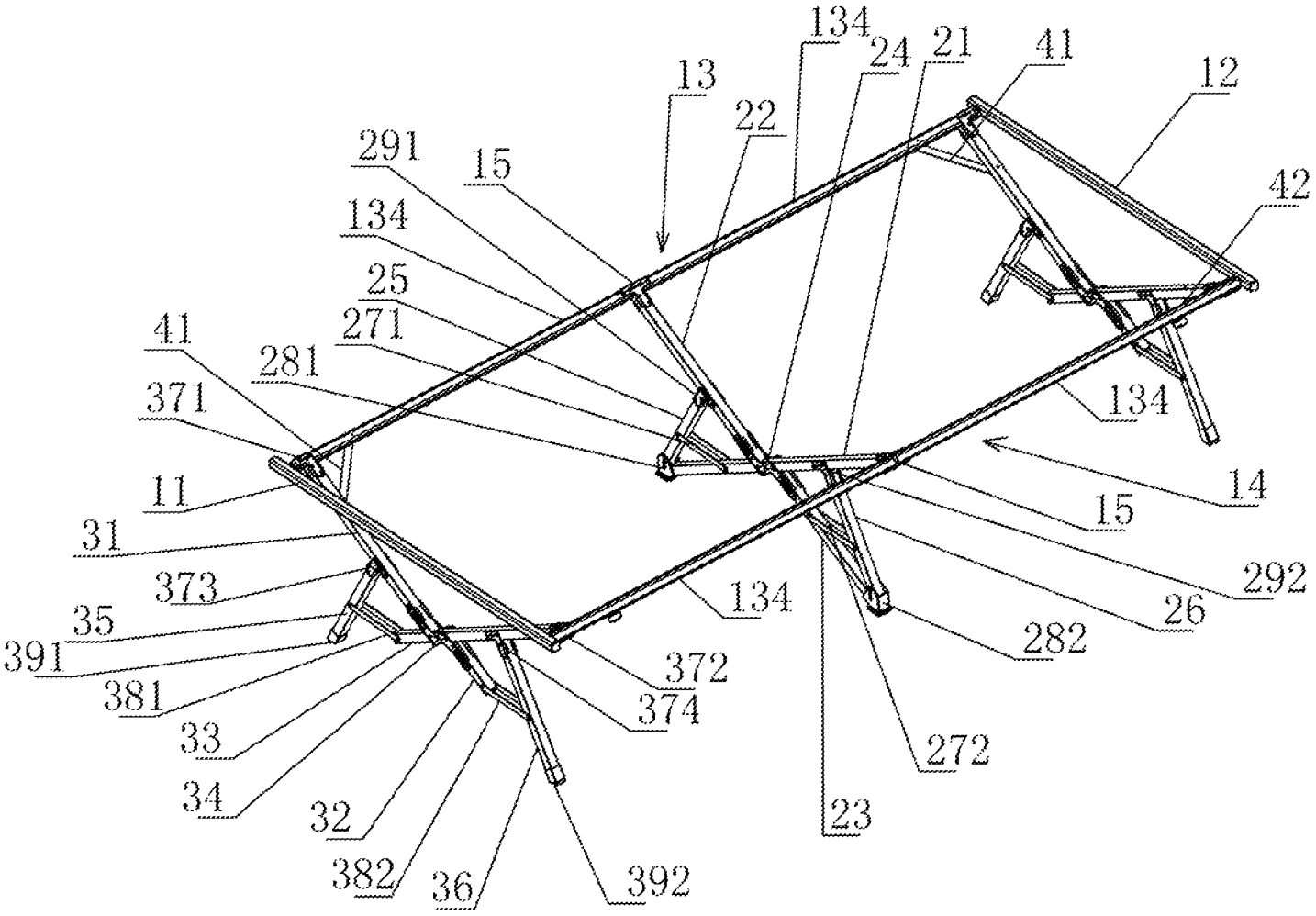
FIG. 1 is a schematic structural view of an embodiment of the present invention, when unfolded.
Figure 2:
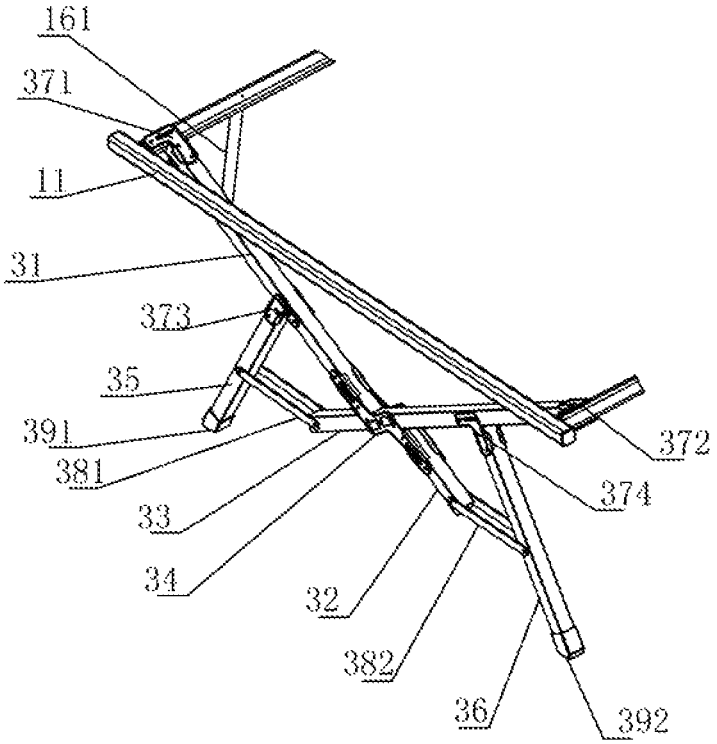
FIG. 2 is an enlarged schematic structural view of the front or rear support frame of the embodiment of FIG. 1, when unfolded.
Figure 3:
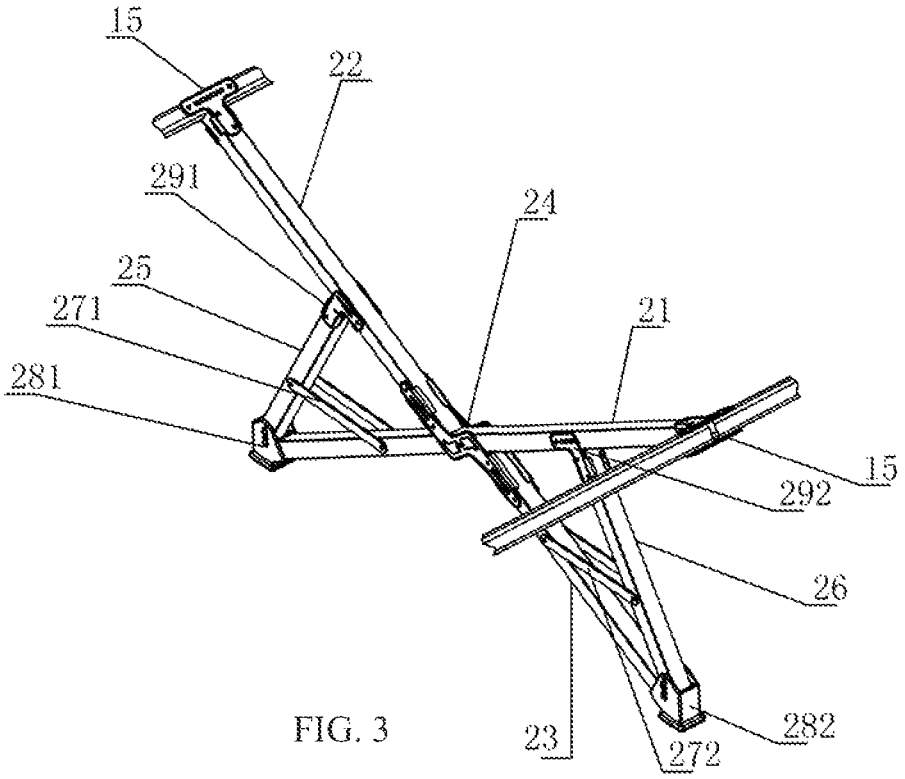
FIG. 3 is an enlarged schematic view of the structure of the intermediate support frame of the embodiment of FIG. 1, when unfolded.
Figure 4:
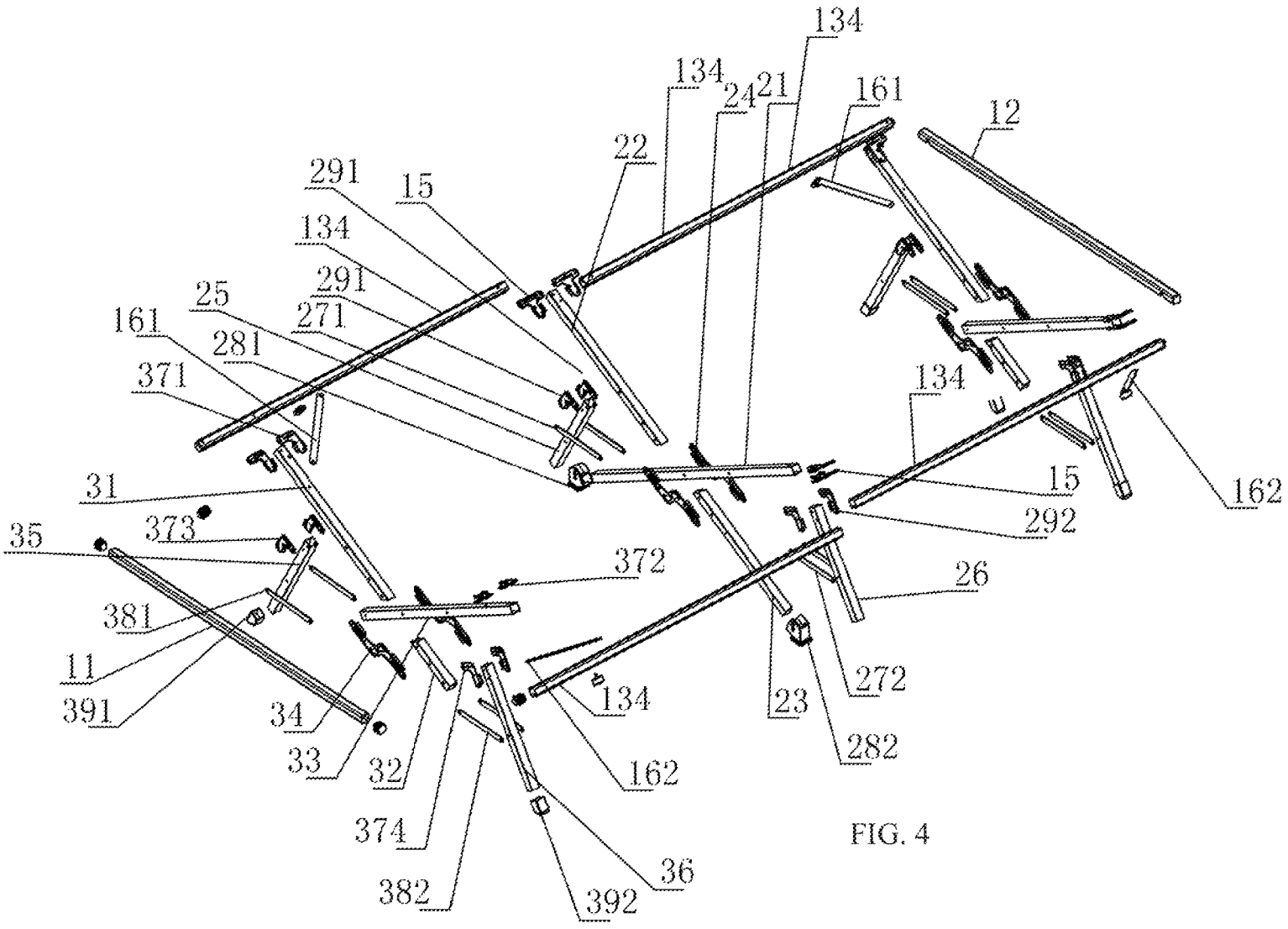
FIG. 4 is a schematic disassembly structural view of the embodiment of FIG. 1 when unfolded.
Figure 5:
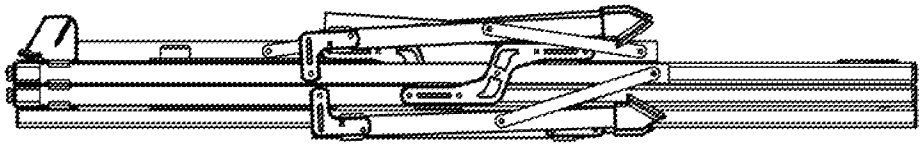
FIG. 5 is a schematic structure view of the embodiment of FIG. 1 when folded.
Figure 6:
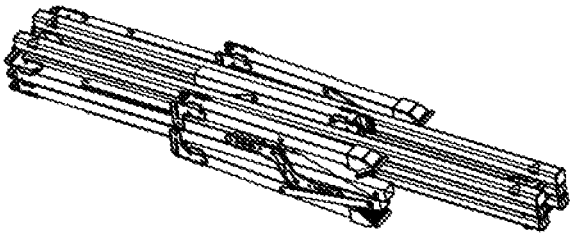
FIG. 6 is a schematic structure view from another direction of the embodiment of FIG. 1 when folded.

Refer to FIG. 1 to FIG. 6, the present invention of enhanced folding bed bracket comprises a head bar 11, a end bar 12, a first side bar 13 and a second side bar 14. two ends of the head bar 11 are inserted in the end of first side bar 13 and the end of second side bar 14 respectively. Two ends of the end bar 12 are inserted in the another end of first side bar 13 and another end of second side bar 14 respectively. Thereby, a rectangle frame for supporting bed cloth is composed. The first side bar 13 and second side bar 14 are composed by two fulcrum bars 134 through the T connecting member 15. The front and rear of the rectangle frame have supporting frames respectively.

Wherein, the intermediate supporting frame located in the middle part of the rectangle frame comprises the intermediate long leg bar 21, first intermediate short leg bar 22, second intermediate short leg 23, first Z connecting member 24, first intermediate lean leg bar 25, first connecting member 271, second intermediate lean leg bar 26 and second connecting member 272.

One end of the first intermediate short leg bar 22 and one end of the second intermediate short leg bar 23 are installed in two ends of the first Z connecting member 24 respectively. The middle part of intermediate long leg bar 21 is hinge jointed with the middle part of first Z connecting member 24. Another end of first intermediate short leg bar 22 and one end of intermediate long leg bar 21 are hinge jointed with the T connecting member 15 located in the middle part of first side bar 13 and the T connecting member 15 located in the middle part of second side bar 14. One end of the first intermediate lean leg bar 25 and one end of second intermediated lean leg bar 26 are fixed with first L connecting member 291 and second L connecting member 292 respectively. The first L connecting member 291 and second L connecting member 292 are hinge jointed on the first intermediate short leg bar 22 and intermediate long leg bar 21 respectively. Two ends of the first connecting member 271 are hinge jointed on the first intermediate lean leg bar 25 and intermediate long leg bar 21 respectively. Two end of the second connecting member 272 are hinge jointed on the second intermediate lean leg bar 26 and second intermediate short leg bar 23 respectively. Another end of the intermediate long leg bar 21 and another end of the second intermediate short leg bar 23 are fixed with the first leg cap 281 and second leg cap 282 respectively. The first leg cap 281 has first socket slot which is for splicing connect for another end of first intermediate lean leg bar 25. The second leg cap 282 has second socket slot which is for slicing connect for another end of second lean leg bar 26.

The supporting frames located in front and rear of the rectangle frame respectively comprise the first front leg bar 31, second front leg bar 32, third front leg bar 33, second Z connecting member 34, first front lean leg bar 35, second front lean leg bar 36, third L connecting member 371, fourth L connecting member 372, fifth L connecting member 373, sixth L connecting member 374, third connecting member 381 and fourth connecting member 382. One end of the first front leg bar 31 and one end of the second front leg bar 32 is connected with two ends of the second Z connecting member 34 respectively. The third front leg bar 33 is hinge jointed with the middle part of second Z connecting member 34. One end of the first front leg bar 31 and one end of the third front leg bar 33 are fixed with third L connecting member 371 and fourth L connecting member 372 respectively. The third L connecting member 371 and fourth L connecting member are hinge jointed with ends of the first side bar 13 and second side bar 14 respectively. Ends of the first front lean leg bar 35 and second front lean leg bar 36 are fixed with the fifth L connecting member 376 and sixth L connecting member 374 respectively. The fifth L connecting member 373 and sixth L connecting member 374 are hinge jointed with the first front leg bar 31 and third front leg bar 33 respectively. Two ends of the third connecting member 381 are hinge jointed with the middle part of first front lean leg bar 35 and other end of third front leg bar 33 respectively. Two ends of the fourth connecting member 382 are hinge jointed with the middle part of second lean leg bar 36 and other end of second front leg bar 32 respectively. The first front lean leg bar 35 and second front lean leg bar 36 are fixed with the third leg cap 391 and fourth leg cap 392.

The first Z connecting member 24 and second Z connecting member 34 are composed respectively by two Z connecting pieces respectively. The T connecting member 15 is composed by two T connecting pieces. The first L connecting member 291, second L connecting member 292, third L connecting member 371, fourth connecting member 372, fifth connecting member 373 and sixth connecting member 374 are composed respectively by two T connecting pieces.

After the enhanced folding bed bracket being unfolded, the first intermediate lean leg bar 25 is vertical to the first intermediate short beg bar 22, the second intermediate lean bag bar 26 is vertical to the intermediate long leg bar 21. The first front lean beg bar 35 is vertical to the second front leg bar 32, the second front lean leg bar 36 is vertical to the third front leg bar 33.

After the folding bed being unfolded, the first intermediate lean leg bar 25 and second intermediate lean leg bar 26 provide good support to the first intermediate short leg bar 22 and intermediate long leg bar 21 respectively. The received forces of the first intermediate short leg bar 22, second intermediate short leg bar 23, intermediate long leg bar 21 and first Z connecting member 24 are decreased respectively, the leg bars are not easy to be distorted. The first front lean leg bar 35, second front lean leg bar 36 are supported by ground. The bottom end of the second front leg bar 32 and the bottom end of the third front leg bar 33 are separated away from ground. The first front lean leg bar 35 and second front lean beg bar 36 provide good support to the second front leg bar 32 and third front leg bar 33 respectively. The received forces of the first front leg bar 31, second front leg bar 32, third front leg bar 33 and second Z connecting member 34 are decreased, the leg bars are not easy to be distorted.

The Folding Process of the Present Invention of Enhanced Folding Bed Bracket:

Remove the head bar 11, end bar 12; turn the first lapping bar 161 and second lapping bar 162; close the first intermediate short leg bar 22 and second intermediate short leg bar 23; during closing process the first intermediate lean leg bar 25 leaves the first socket slot 2811 to turn to close on the first intermediate short leg bar 22; the second intermediate lean leg bar 26 leaves the second socket slot 2812 to turn to close on the intermediate long leg bar 21; the drawing the intermediate supporting frame in is completed. In the meantime, the first front lean leg bar turns and closes on the first front leg bar 31, the second front lean leg bar 36 turns and closes on the third front leg bar 33, the drawing front supporting frame in is completed. The front supporting frame turns around the first side bar 13 and second side bar 14, turns over above the first side bar 13 and second side bar 14 to close on the first and second side bar 13 and 14. Thereafter, two fulcrum bars 134 connected with the T connecting member 15 turn in opposite direction respectively around the T connecting member 15. In meantime the supporting frames which are closed on the fulcrum bars turn together with the turning of the fulcrum bars. Thereby, the folding process is completed. Refer to the FIGS. 5-6, the unfolding process can be completed according to the folding process.

The above detail description is for understanding the present invention. The skill person in the field may make different modifications, which shall fall in the scope of claims of the present patent application.

What is claimed is:

1. An enhanced folding bed bracket comprising:

a head bar (11), an end bar (12), a first side bar (13), a second side bar (14); a rectangle frame composed by the head bar (11), the end bar (12), the first side bar (13) and the second side bar (14), and a bed cloth supported by the rectangle frame; the first side bar (13) and the second side bar (14) are composed respectively by two fulcrum bars (134) which are connected by a T connecting member (15) respectively; three support frames are provided in front, rear and middle of the rectangle frame respectively;

the support frame located in middle of the rectangle frame comprises an intermediate long leg bar (21), a first intermediate short leg bar (22), a second intermediate short leg bar (23) and a first Z connecting member (24); two first ends of the first and second intermediate short leg bars (22), (23) are installed in first and second ends of the first Z connecting member (24) respectively; a middle part of the intermediate long leg bar (21) is hinge jointed with a middle part of the first Z connecting member (24); a second end of the first intermediate short leg bar (22) and a first end of the intermediate long leg bar (21) are hinge jointed with the T connecting member (15) located in a middle part of the first side bar (13) and the T connecting member (15) located in the middle part of the second side bar (14) respectively; wherein the support frame located in middle of the rectangle frame further comprises a first intermediate lean leg bar (25), a first connecting member (271), a second intermediate lean leg bar (26) and a second connecting member (272); two first ends of the first and second intermediate lean leg bars (25), (26) are fixed with a first and a second L connecting members (291), (292) respectively; the first L connecting member (291) and the second L connecting member (292) are hinge jointed with the first intermediate short leg bar (22) and the intermediate long leg bar (21) respectively; a first and a second ends of the first connecting member (271) are hinge jointed with the first intermediate lean leg bar (25) and the intermediate long leg bar (21) respectively; a first and a second ends of the second connecting member (272) are hinge jointed with the second intermediate lean leg bar (26) and the second intermediate short leg bar (23) respectively; a second end of the intermediate long leg bar (21) and a second end of the second intermediate short leg bar (23) are fixed with a first leg cap (281) and a second leg cap (282) respectively; the first leg cap (281) has a first socket slot which is rotatable to connect with a second end of the first intermediate lean leg bar (25); the second leg cap has a second socket slot which is rotatable to connect with a second end of the second intermediate lean leg bar (26).

2. The enhanced folding bed bracket of claim 1, wherein each one of the support frames located in front and rear of the rectangle frame comprises a first front leg bar (31), a second front leg bar (32), a third front leg bar (33), a second Z connecting member (34), a first front lean leg bar (35), a second front lean leg bar (36), a third L connecting member (371), a fourth L connecting member (372), a fifth L connecting member (373), a sixth L connecting member (374), a third connecting member (381) and a fourth connecting member (382); a first end of the first front leg bar (31) and a first end of the second front leg bar (32) are installed in first and second ends of the second Z connecting member (34) respectively; the third front leg bar (33) is hinge jointed with a middle part of the second Z connecting member (34); a second end of the first front leg bar (31) and a second end of the third front leg bar (33) are fixed with the third L connecting member (371) and the fourth L connecting member (372) respectively; the third L connecting member (371) and the fourth L connecting member (372) are hinge jointed with a first end of the first side bar (13) and a first end of the second side bar (14) respectively;

a first end of the first front lean leg bar (35) and a first end of the second front lean leg bar (36) are fixed with the fifth L connecting member (373) and the sixth L connecting member (374) respectively; the fifth L connecting member (373) and the sixth L connecting member (374) are hinge jointed with the first front leg bar (31) and the third front leg bar (33) respectively; first and second ends of the third connecting member (381) are hinge jointed with a middle part of the first front lean leg bar (35) and a first end of third front leg bar (33) respectively; first and second ends of the fourth connecting member (382) are hinge jointed with a middle part of the second front lean leg bar (36) and a second end of the second front leg bar (32) respectively.

3. The enhanced folding bed bracket of claim 2, wherein the first Z connecting member (24) and second Z connecting member (34) are composed respectively by two Z connecting pieces, the T connecting member (15) is composed by two T connecting pieces, the first, second, third, fourth, fifth and sixth L connecting members (291, 292, 371, 372, 373, 374) are composed respectively by two T connecting pieces.

4. The enhanced folding bed bracket of claim 1, wherein after the enhanced folding bed bracket being unfolded, the first intermediate lean leg bar (25) is vertical to the first intermediate short leg bar (22), the second intermediate lean leg bar (26) is vertical to the intermediate long leg bar (21).

5. The enhanced folding bed bracket of claim 1, wherein after the enhanced folding bed bracket being unfolded, the first front lean leg bar (35) is vertical to the first front leg bar (31), the second front lean leg bar (36) is vertical to the third front leg bar (33).

6. The enhanced folding bed bracket of claim 1, wherein first and second ends of the head bar (11) are rotatable to connect with a first end of first side bar (13) and a first end of the second side bar (14) respectively, first and second ends of the end bar (12) are rotatable to connect with a second end of the first side bar (13) and a second end of the second side bar (14), thereby, the rectangle frame for supporting the bed cloth is composed.

7. The enhanced folding bed bracket of claim 1, wherein the first front leg bar (31) is hinge jointed with the first lapping bar 161 used for lapping on the first side bar (13), the third front leg bar (33) is hinge jointed with the second lapping bar 162 used for lapping on the second side bar (14).

8. An enhanced folding bed bracket comprising:

a head bar (11), an end bar (12), a first side bar (13) and a second side bar (14), the head bar (11); the end bar (12), the first side bar (13) and the second side bar (14) compose a rectangle frame to support a bed cloth; the first side bar (13) and the second side bar (14) are composed respectively by two fulcrum bars (134)

which are connected by a T connecting member (15) respectively; a front, rear and middle of the rectangle frame are provided with support frames; wherein each one of the support frames located in front and rear of the rectangle frame comprises a first front leg bar (31), a second front leg bar (32), a third front leg bar (33), a second Z connecting member (34), a first front lean leg bar (35), a second front lean leg bar (36), a third L connecting member (371), a fourth L connecting member (372), a fifth L connecting member (373), a sixth L connecting member (374), a third connecting member (381) and a fourth connecting member (382); a first end of the first front leg bar (31) and a first end of the second front leg bar (32) are installed in first and second ends of the second Z connecting member (34) respectively; the third front leg bar (33) is hinge jointed in a middle part of the second Z connecting member (34); a second end of the first front leg bar (31) and a second end of the third front leg bar (33) are fixed with the third L connecting member (371) and the fourth L connecting member (372) respectively; the third L connecting member (371) and the fourth L connecting member (372) are hinge jointed with a second end of the first side bar (13) and a second end of the second side bar (14) respectively; a first end of the first front lean leg bar (35) and a first end of the second front lean leg bar (36) are fixed with the fifth L connecting member (373) and the sixth L connecting member (374) respectively;

the fifth L connecting member (373) and the sixth L connecting member (374) are hinge jointed with the first front leg bar (31) and the third front leg bar (33) respectively; first and second ends of the third connecting member (381) are hinge jointed with a middle part of the first front lean leg bar (35) and a first end of the third front leg bar (33) respectively; first and second ends of the fourth connecting member (382) are hinge jointed with a middle part of the second front lean leg bar (36) and a second end of the second front leg bar (32) respectively.

9. The enhanced folding bed bracket of claim 8, wherein after the enhanced folding bed bracket being unfolded, the first front lean leg bar (35) is vertical to the second front leg bar (32), the second front lean leg bar (36) is vertical to the third front leg bar (33).

10. The enhanced folding bed bracket of claim 8, wherein the first front lean leg bar (35) and the second front lean leg bar (36) are fixed with a third leg cap (391) and a fourth leg cap (392) respectively.

* * * * *